United States Patent [19]

Tullos

[11] Patent Number: 4,629,386

[45] Date of Patent: Dec. 16, 1986

[54] RAILROAD HOPPER CAR DOOR OPENER

[75] Inventor: Melvin L. Tullos, Houston, Tex.

[73] Assignee: Port of Houston Authority, Houston, Tex.

[21] Appl. No.: 801,800

[22] Filed: Nov. 26, 1985

[51] Int. Cl.[4] ..... B65G 67/24

[52] U.S. Cl. ..... 414/376; 414/572

[58] Field of Search ..... 414/339, 390, 376, 377, 414/378, 373, 572; 222/505; 105/239, 240, 286

[56] References Cited

U.S. PATENT DOCUMENTS

| | | | |
|---|---|---|---|
| 2,355,226 | 8/1944 | Mallory | 414/390 X |
| 3,419,165 | 12/1968 | Haditsch | 414/376 |
| 3,965,760 | 6/1976 | Etheredge, Jr. | 414/376 X |
| 4,522,545 | 6/1985 | Peckham | 414/376 |

*Primary Examiner*—Robert J. Spar
*Assistant Examiner*—Stuart J. Millman
*Attorney, Agent, or Firm*—Kenneth D. Baugh

[57] ABSTRACT

A railroad hopper car door opener 40 is provided for opening a railroad hopper car door 20. The hopper car door opener 40 includes a first elongated member 44 which is mounted to rotate on a platform 52 adjacent a hopper car unloading area. A second elongated member 46 is pivotably mounted on one end thereof to the other end of the first elongated member 44. The first and second elongated members 44 and 46 have a curve 48 and 58 respectively formed at a predetermined point thereon to facilitate optimum conditions for movement. A third elongated member 78 is provided which is tapered at one end thereof to engage a car door socket 34. A motor 74 is coupled to the end of the third elongated member 78 opposite the tapered end thereof and pivotably mounted to the other end of the second elongated member 46. The motor 47 is provided to rotate the third elongated member 78 about a horizontal axis. A fourth member 100 coupled to the second elongated member 48 adjacent the motor 74 facilitates manual movement of the first and second elongated members 46 and 48 and activation of the motor 74 by an operator.

7 Claims, 3 Drawing Figures

RAILROAD HOPPER CAR DOOR OPENER

TECHNICAL FIELD

The invention relates to a vehicle unloading apparatus. More particularly the invention relates to a railroad hopper car door opener.

Railroad freight cars which discharge their load from the bottom are generally known as hopper cars. Hopper cars are provided with a discharge opening on the underside of the car adjacent the railroad track. A door is mounted over the discharge opening on a shaft which extends from the side of the car. The shaft can be turned to operate other mechanisms associated therewith to open and close the hopper car door. Hopper cars are used extensively for carrying loads which are then discharged into a storage facility under ground or onto a conveyor belt to be moved to a dumpsite such as a ship.

One of the more difficult parts of this operation is opening and closing the hopper car door which is normally very heavy. Accordingly, it is desirable to provide an apparatus for easily opening and closing the hopper car door.

BACKGROUND ART

Attempts have been made to provide apparatus that will facilitate opening and closing of the hopper car door. In the past, this task has been accomplished manually by an operator turning the shaft of the hopper car door with a wrench. This procedure is simple but difficult because of the weight of the hopper car door. Thus it is not very desirable.

Power wrenchs and other powerized equipment have also been employed. One arrangement is illustrated in U.S. Pat. No. 3,965,760. This arrangement requires that the existing shaft arrangement of the hopper car be adapted to include a turning means having a series of gears and other mechanical parts. This means having a myriad of gears and other parts can then be activated by a motor to open and close the hopper car door. U.S. Pat. No. 3,419,165 discloses another apparatus for opening and closing the hopper car door. This arrangement in addition to numerous other mechanical parts includes a member having two portions pivotably coupled to each other and a third portion for engaging a hopper car door opening member to open the door.

DISCLOSURE OF INVENTION

This invention relates to a railroad hopper car door opener. A railroad hopper car door opener is provided for engaging a hopper car door socket to open a railroad hopper car. The hopper car door opener includes a first horizontally extending elongated member having a curve formed therein. The first horizontally extending elongated member is mounted to rotate at one end thereof about a vertical axis on a platform adjacent a hopper car unloading area. A second horizontally extending elongated member is provided having a curve formed therein. This member is pivotably mounted at one end thereof to the other end of the first horizontally extending elongated member. A third horizontally extending elongated member is provided for engaging the hopper car door socket. Means are provided for coupling the third horizontally extending elongated member to the second horizontally extending elongated member and for rotating the third horizontally extending elongated member to open the hopper car door.

BRIEF DESCRIPTION OF THE DRAWING

The details of the invention will be described in connection with the accompanying drawing in which.

BEST MODE FOR CARRYING OUT THE INVENTION

Figure 1:
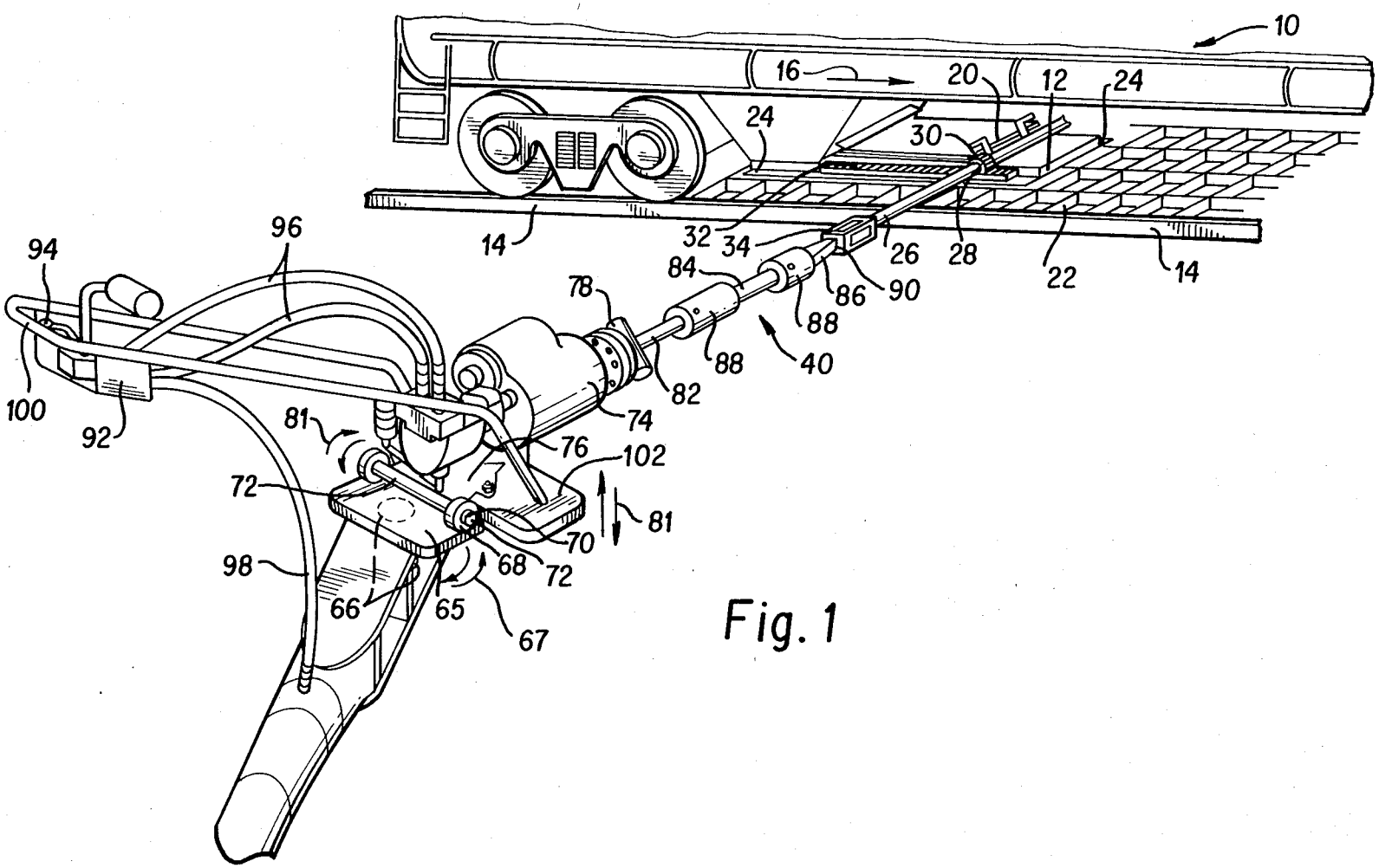
FIG. 1 is a partial side view of a railroad hopper car showing a portion of a hopper car door opener in accordance with the principles of the invention.

Referring to FIG. 1, a conventional railroad hopper car generally designated by the numeral 10 is shown having wheels 12 which are movable along a pair of tracks 14 (only one shown). The hopper car 10 is formed of sloped walls which form a hopper 16 for carrying and releasing material held therein. An opening 18 is formed on the underside of the hopper 16. A door 20 which covers the opening 18 allows the release of the contents of the hopper into an open area 22 when the door 20 is opened.

The door 20 is supported for movement in a well known manner on a support rack 24. A pinion shaft 26 is rotatably mounted on the rack 24. A pinion generally designated as 28 having teeth 30 formed therein is coupled to each end of the pinion shaft 26. The pinions 28 are aligned so that the teeth 30 engage an associated slotted pinion rack 32 (only one side shown) mounted on the support rack 24. A capstan or car door socket 34 (only one shown) is coupled to each end of the pinion shaft 26 to permit rotation of the shaft and pinions 28. Rotation of the pinions 28 on the pinion rack 32 opens and closes the door 20 in a well known manner.

Figure 2:
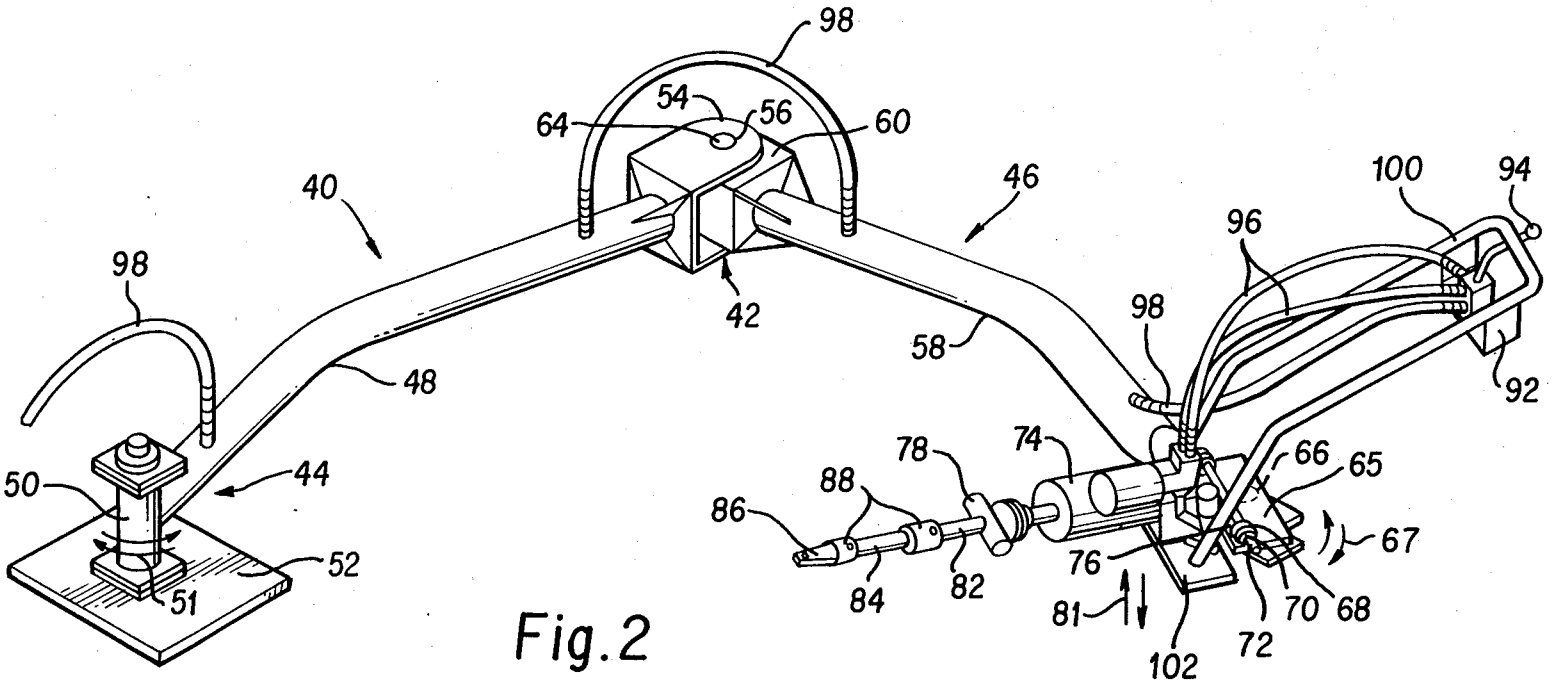
FIG. 2 is a front prospective view of the hopper car door opener in accordance with the principles of the invention.
Figure 3:
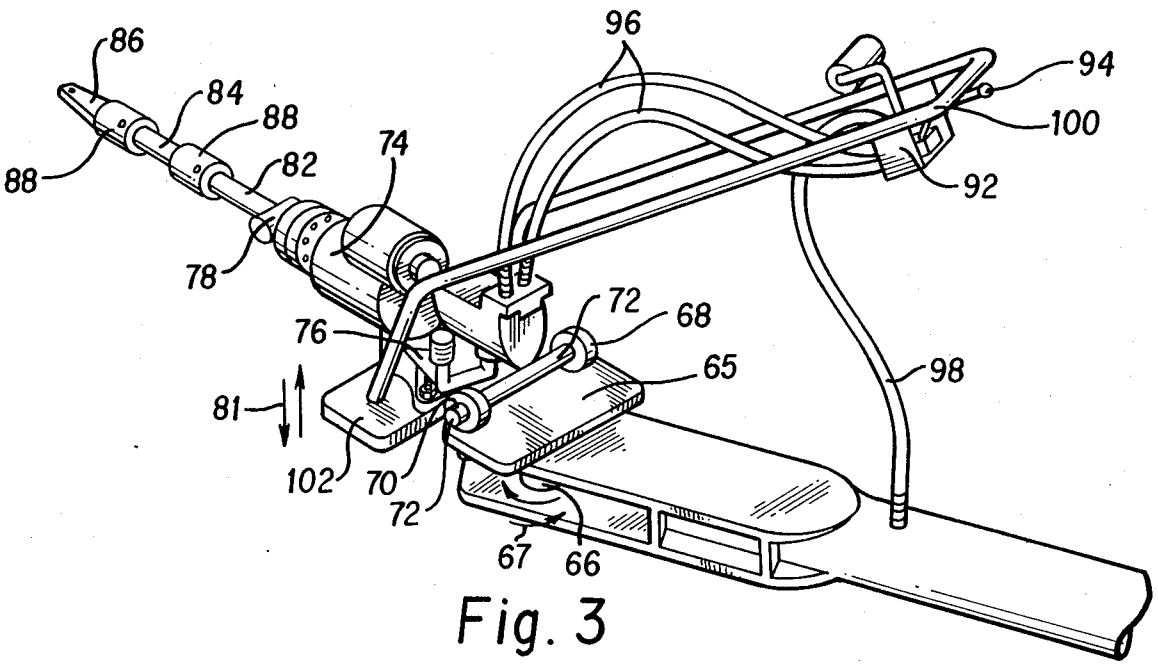
FIG. 3 is a partial rear prospective view of the hopper car door opener in accordance with the principles of the invention.

A hopper car door opener generally designated by the number 40 is provided for opening the hopper car door 20 of the hopper car 10. Referring specifically to FIGS. 2 and 3 the hopper car door opener 40 includes a horizontally extending enlongated support arm generally designated by the numeral 42. The elongated support arm 42 includes first and second elongated members generally designated by the numerals 44 and 46 respectively.

The first elongated member 44 is formed having a curve 48 formed at an intermediate portion thereof. The first elongated member 44 has a vertically extending shaft assembly 50 coupled to one end thereof. The shaft assembly 50 is mounted for rotation about a vertical axis as indicated by arrows 51. The shaft assembly 50 is mounted on a platform 52 adjacent the hopper car 10. The first elongated member 44 is formed with a U-shaped coupling member generally designated by the numeral 54 at the end opposite the shaft assembly 50. The U-shaped coupling member 54 includes a pair of spaced aligned apertures 56 (only one shown) formed therein.

The second elongated member 46 of the support arm 42 is formed with a curve 58 at and intermediate portion thereof and a square shaped coupling member 60 which fits into the U-shaped coupling member 54. The square shaped coupling member 60 includes an aperture 62 formed there through which is aligned with the apertures 56 in the U-shaped coupling member 54. The square shaped coupling member 60 is pivotably held in the U-shaped coupling member 54 by a pin 64 which projects through the apertures 56 and 62. The coupling members 54 and 60 allow pivotable movement between the elongated members 44 and 46.

The curves 48 and 58 of the first and second elongated members 44 and 46 respectively facilitate optimum conditions for movement of the elongated members. That is, by providing the curves 48 and 58 the support arm 42 can be manuevered easily to the desired location as if there were additional pivot points in the arm. The elongated members 44 and 46 are made for example of steel and are hollow on the inside.

The second elongated member 46 of the support arm 42 has a support platform 65 rotatably mounted thereto about a vertical axis by a shaft 66. As illustrated in FIGS. 2 and 3 the shaft 66 allows the support platform 65 to be rotated as indicated by the arrows 67. The support platform 65 includes a pair of spaced aligned upstanding members 68 and 70 each having an aperture 72 formed therein.

A motor 74 is provided having a support member 76 and a rotating shaft 78. The support member 76 of the motor 74 includes a coupling shaft 80 which extends into the aperture 72 of the upstanding members 68 and 70. This couples the motor for pivotable vertical movement on the support platform 65 of the support arm 42 as indicated by arrows 81. The motor 74 is activated by air and may be for example a multi-vane air motor.

The shaft 78 of the motor 74 is formed of three intersecting shaft members 82, 84 and 86. The shaft members 82, 84, and 86 are coupled together by coupling members 88. The coupling members 88 have dimensions that will allow the coupling members to securely hold an appropriate end of the respective shaft members therein. It should be realized that the shaft 78 may be formed of a series of extensions having a coupling portion attached thereto or may be one integral piece. The shaft member 86 is formed with a tapered end 90 which engages the car door socket 34 (FIG. 1) when the car door opener 40 is being used.

The motor 74 is activated to rotate the shaft 78 by an air valve 92 having an activating arm 94. The valve 92 controls the flow of air to the motor through air hoses 96 coupled from the air valve to the motor. The air valve 92 allows the motor 74 to be activated by turning the valve in one direction or the other thus causing the motor to turn the shaft 78 of the motor in either a clockwise or counter clockwise direction. The air valve 92 may be for example a rotary type air valve. Air is feed to the valve 92 through a air hoses 98 which are coupled into the hollow support arm 42 to an air compressor (not shown) which provides the source of power for the motor 74. The support arm 42 also serves as a conduit for the air from the air compressor because of its hollow interior.

The air valve 92 is mounted on a control arm 100 which is coupled to the support member 76 of the motor 74 by a base member 102. The control arm 100 allows an operator to easily move the support arm 42 and motor 74 to any desired position.

When a hopper car 10 is to be unloaded it is moved to a predetermined position over the open area 22 in a hopper car unloading area. The hopper car door opener 40 is then picked up by an operator and maneuvered so that the member 86 of the shaft 78 engages the socket 34 of the hopper car. It should be understood that the the support arm 42 may be rotated about the shaft assembly 50 and pivoted at the point of the couplers, 54 and 60 to properly position the door opener 40. Additional, maneuverability is provided by rotating the motor 74 on the shaft 66 and pivoting the motor up and down as desired on the support platform 65.

Once the hopper car door opener 40 engages the socket 34 the motor 74 is then activated by the valve 92 to turn the shaft 78 in a counter clockwise direction. This causes the pinions 28 to move on the pinion rack 33 to open the door 20. As the door 20 is opened the contents of the hopper car 10 are released into the open area 22 in the unloading area. When it is desired to close the hopper car door 20 the motor 74 is activated to turn the shaft 78 in the clockwise direction. This causes the pinions 28 to move on the pinion rack 32 in the opposite direction thus closing the door.

It is to be understood that other arrangements as well as various changes and modifications may be made by those skilled in the art without departing from the spirit and scope of the invention.

What is claimed:

1. A railroad hopper car door opener for engaging a hopper car door socket and opening a railroad hopper car door including:

a first horizontally extending elongated member having a curve formed therein mounted to rotate about a vertical axis;

a second horizontally extending elongated member having a curve formed therein pivotably coupled to the first horizontally extending elongated member;

a third horizontally extending elongated member for engaging the hopper car door socket; and means for coupling the third horizontally extending elongated member to the second horizontaly extending elongated member and for rotating the third horizontally extending elongated member to open the hopper car door.

2. A hopper car door opener as defined in claim 1 wherein the third horizontally extending elongated member coupling and rotating means includes;

a motor for rotating the third horizontally extending elongated member;

means for activating the motor;

means for pivotably coupling the motor to the second horizontally extending elongated member for vertical movement thereon; and means for coupling the motor for rotation about a vertical axis on the second horizontally extending member.

3. A hopper car door opener as defined in claim 2 wherein the third horizontaly extending elongated member is tapered at one end thereof to facilitate engagement with the car door socket.

4. A hopper car door opener as defined in claim 3 further including means coupled to the second horizontally extending elongated member adjacent the motor for facilitating manual movement of the first, second and third horizontally extending elongated members.

5. A hopper car door opener as defined in claim 4 wherein the means for activating the motor includes:

a valve;

means coupled to the valve for providing a source of air to the valve; and means coupled from the valve to the motor for carrying air to the motor upon activation of the valve.

6. A hopper car door opener as defined in claim 5 wherein the means for coupling the motor for rotation on the second horizontally extending elongated member includes:

a platform for supporting the second horizontally extending elongated member; and a shaft coupled for rotation between the platform and the second horizontally extending elongated member so that the motor can be rotated about a vertical axis on the second horixontally extending elongated member.

7. A hopper car door opener as defined in claim 6 wherein the means for pivotable coupling the motor to the second horizontally extending elongated member for vertical movement thereon includes:

a pair of spaced aligned upstanding support members coupled to the platform of the motor rotation coupling means;

a motor support bracket coupled to the motor; and a shaft coupled to the motor support bracket and the upstanding support member so that the shaft can rotate between the upstanding support members thereby permitting pivotable vertical movement of the motor.

* * * * *